United States Patent [19]

Fuller et al.

[11] 4,063,648

[45] Dec. 20, 1977

[54] DISPLAY SYSTEM FOR SAMPLES

[76] Inventors: Robert T. Fuller, 1351 Empire St., Anaheim, Calif. 92804; Robert J. Sanders, 2200 Oshkosh Circle, Anaheim, Calif. 92806

[21] Appl. No.: 597,381

[22] Filed: July 18, 1975

[51] Int. Cl.[2] ..... A47F 7/16

[52] U.S. Cl. ..... 211/45; 211/113; 40/125 H

[58] Field of Search ..... 211/44–48, 211/113, 119, 124; 248/DIG. 3, 214, 215; 40/28, 106, 104.18, 104.19, 125; 35/28, 28.3, 28.5, 49, 50, 55, 53

[56] References Cited

U.S. PATENT DOCUMENTS

| | | | |
|---|---|---|---|
| 2,865,124 | 12/1958 | Mortellito | 40/125 H |
| 2,954,874 | 10/1960 | Rouse | 211/13 |
| 3,185,308 | 5/1965 | Howard | 211/45 |
| 3,195,733 | 7/1965 | Best | 211/45 |
| 3,224,113 | 12/1965 | Goldsholl | 35/28.3 |
| 3,514,875 | 6/1970 | Howard | 35/55 |
| 3,862,687 | 1/1975 | Pirman | 211/113 X |
| 3,871,524 | 3/1975 | Helf | 211/45 |
| 3,871,608 | 3/1975 | Ogden | 248/DIG. 3 |

FOREIGN PATENT DOCUMENTS

| | | | |
|---|---|---|---|
| 659,883 | 2/1965 | Belgium | 211/45 |
| 884,971 | 11/1971 | Canada | 35/55 |
| 1,228,924 | 9/1960 | France | 211/45 |
| 1,239,188 | 4/1967 | Germany | 211/45 |

*Primary Examiner*—Roy D. Frazier
*Assistant Examiner*—Terrell P. Lewis
*Attorney, Agent, or Firm*—D. Gordon Angus; Donald D. Mon

[57] ABSTRACT

A display system for displaying samples, for example, floor covering samples such as carpets and rugs. A perforated support board supports samples which are removably attached thereto by separable fasteners. Stand means may be provided to hold the support board. Samples may be shingled or displayed side-by-side, and the apertures in the support board are arranged so as to permit a variety of display patterns.

42 Claims, 33 Drawing Figures

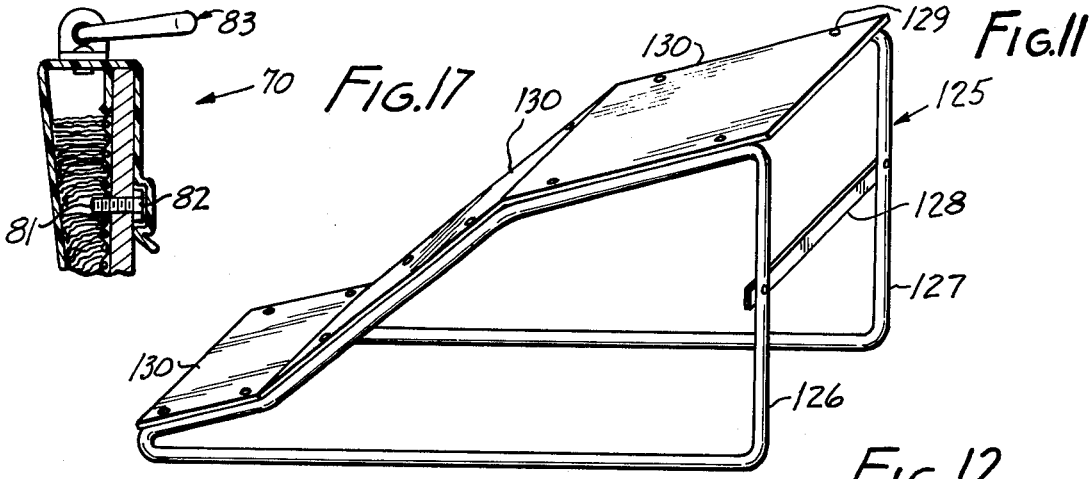
FIG. 17
FIG. 11
FIG. 12
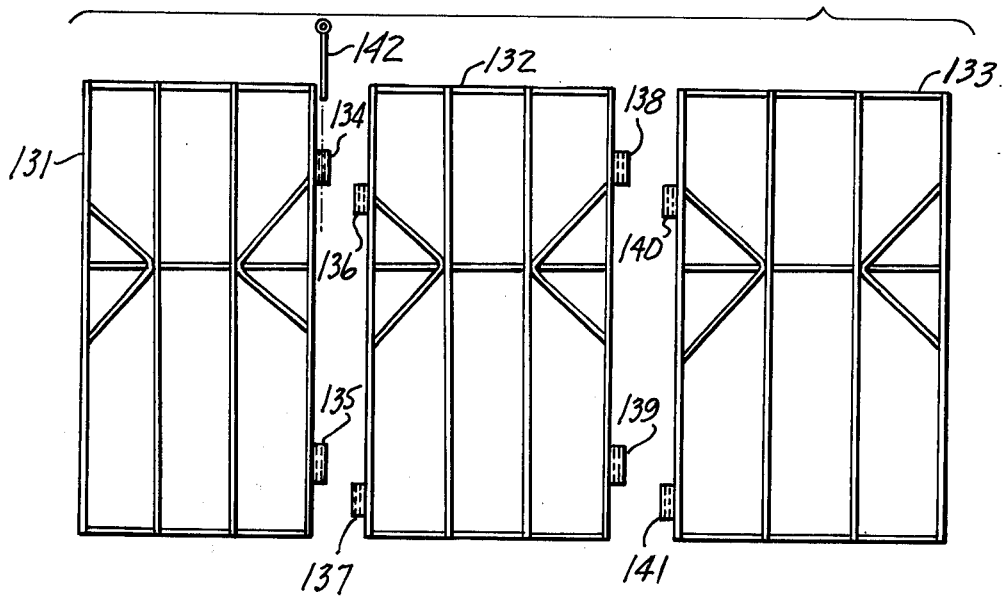
FIG. 13
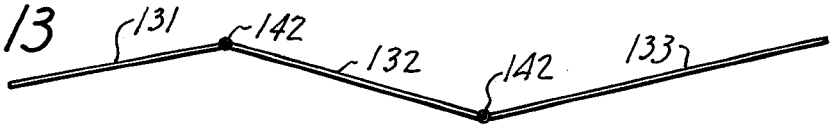
FIG. 14
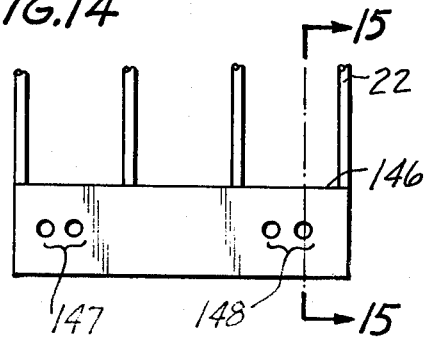
FIG. 16
FIG. 15
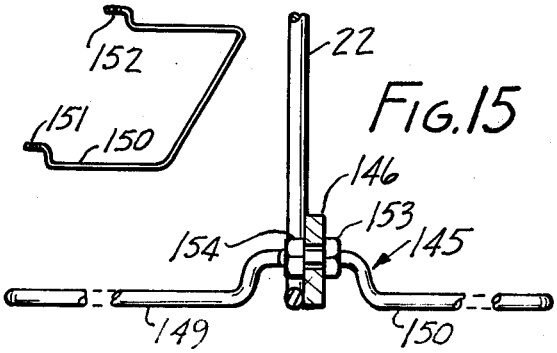

DISPLAY SYSTEM FOR SAMPLES

This invention relates to the display of samples.

Floor covering samples furnished to the trade, especially of carpet samples, constitute a very major expense to the carpet manufacturer. Large shop areas and substantial numbers of people are kept occupied in making up collections of samples which are distributed to retailers for attracting customers. It is ironic that presently-existing sample display systems, for all of their expense, still fail to show on their face more than a small proportion of the available colors of a line when relatively large samples are provided. When small enough samples are provided that all colors can be shown at once, they are usually glued to a backboard from which they are frequently torn so the customer can take it home, leaving an unsightly bare area on the display. With the latter arrangement, removal and replacement of the glued-on articles is not practicable in the trade for updating the line. As a consequence, even the most expensive currently-known sample display systems fail to have the capacity to display a current line of samples with every color visible to the shopper. As a consequence of the foregoing shortcomings of the prior art, a person shopping for carpets usually sees only the color of the top sample in a stack, and as a matter of market psychology, if the shopper does not care for that color, the sale may be considered lost, because she is likelier to go to a different sample collection with a more agreeable top color than to leaf through a stack which has a disfavored top color.

It is another irony of the prior art that the most important sales aid in selling floor coverings—the sample collection—is usually stacked around in piles on the floor where it must be dug or sorted out from the other collections, and occupies considerable floor space. To avoid this, sometimes carriers of samples are hung by means of a luggage handle from some kind of hook. In either event, the display is less than attractive, is heavy, troublesome to get hold of, and must be lugged around by the prospective shopper in the expectation of finding a desirable floor covering after she finds a place to put it down. This constitutes just too much work for many shoppers, and sales are frequently lost for this reason alone.

Much of the sample trade has settled on a luggage-type carrier with a U-shaped edge clamp bearing a luggage-type handle, and with bolts passed through holes that have been punched in the carpet samples. The assembly and disassembly of samples in this type of carrier is both costly and difficult, and as a consequence the samples usually get cut up to provide shoppers with small pieces. Near the end of the season, such a sample collection is unsightly and makes a poor presentation.

It is an object of this invention to provide a display system for samples of floor coverings which:

1. is adaptable to the easy attachment and removal and replacement of individual carpet samples;
2. can display all colors of a given type of carpet so that they are simultaneously visible to the purchaser; and
3. can be supported by free-standing means, as well as by fixed means.

As a consequence of these features, collections of samples can initially be made up inexpensively by semi-skilled labor, and even with unskilled labor, after very short training; can be displayed tastefully as complete collections while occupying minimal floor space; can be knocked down for shipment in minimal bulk; and can be made adaptable to the display of samples in several basic sizes without requiring the re-education of assembling personnel or the use of skilled labor to assemble the collection.

A floor covering display system according to the invention includes a support board with perforations appropriately sized to receive separable fasteners attached to samples whereby to hold them for display purposes.

According to a preferred but optional feature of the invention, the separable fasteners may include prong-like members which pass through the sample and engage the backside of the support board.

According to another preferred but optional feature of the invention, floor stand means is provided to which the support board may removably be attached. The floor stand means may have foot members, whereby to be rendered free-standing, and the foot members can have rotatable means, if desired. Also, means can be provided to join the floor stand means together so they are mutually supporting.

According to still another preferred but optional feature of the invention, a finishing strip may be provided for the upper edge of the support board which overlaps and trims the top edge of the uppermost sample and which, if desired, may shield and protect the uppermost of the separable fasteners to guard against accidental removal of the topmost sample.

The above and other features of this invention will be fully understood from the following detailed description and the accompanying drawings, in which:

FIG. 11 is a perspective view of another embodiment of the invention;

FIG. 12 is a front elevation of another embodiment of the invention shown in a disassembled condition;

FIG. 13 is a top view showing the elements of FIG. 12 assembled and free-standing;

FIG. 14 is a front elevation showing a fragment of another embodiment of the invention;

FIG. 15 is a cross-section taken at line 15—15 of FIG. 14;

FIG. 16 is a perspective view of a portion of FIGS. 14 and 15;

FIG. 17 is a fragmentary cross-section illustrating another optional feature of the invention;

Figure 1:
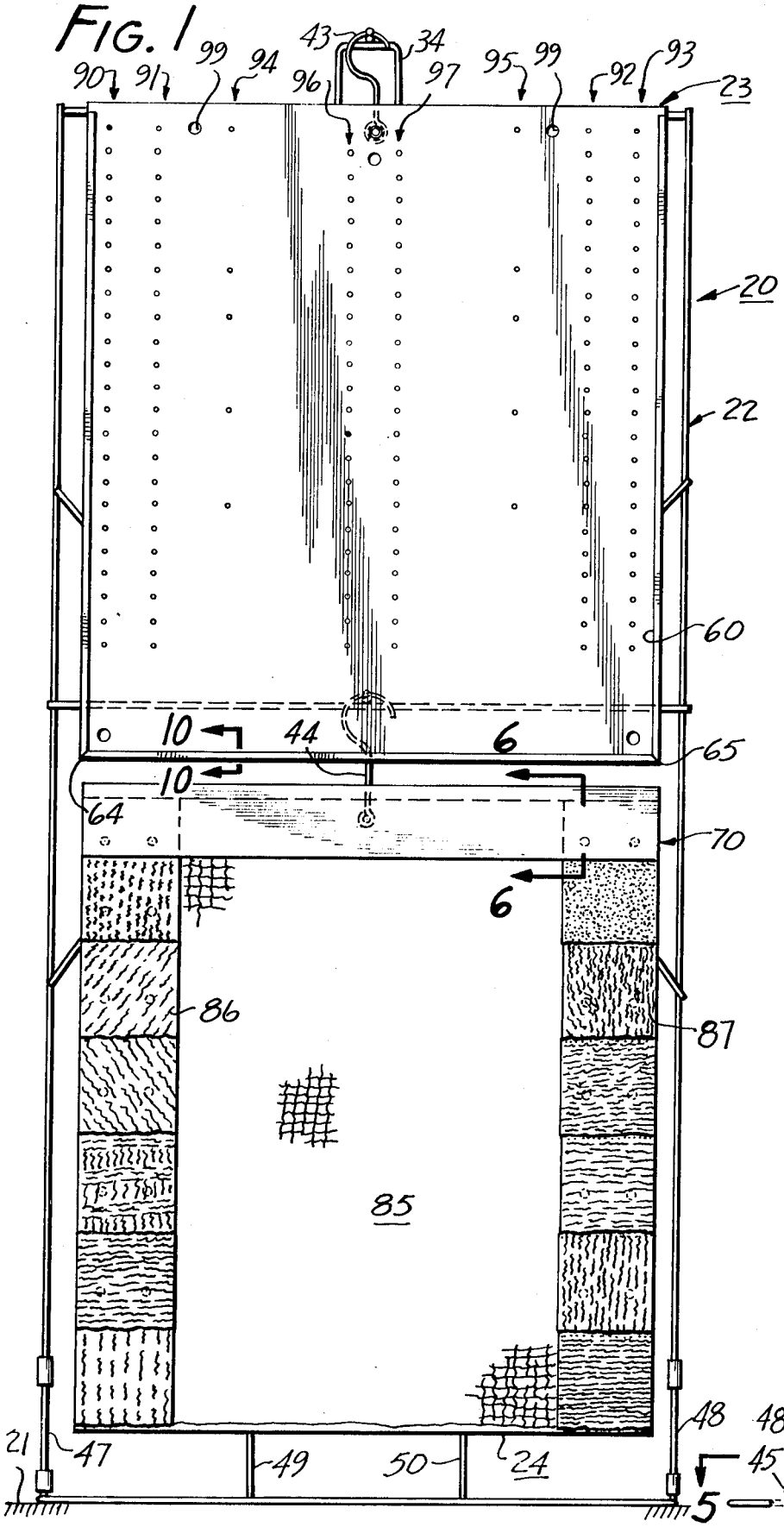
FIG. 1 is a front elevation of an embodiment of the invention.

One embodiment of the invention is shown in FIG. 1, wherein a display system 20 is shown in a free-standing condition adapted to rest on the floor 21. The system includes a floor stand member 22 and at least one support board 23. In fact, two support boards 23 and 24 are shown. They may be attached to either or both of the front and the back sides of the floor stand member as desired.

Figure 3:
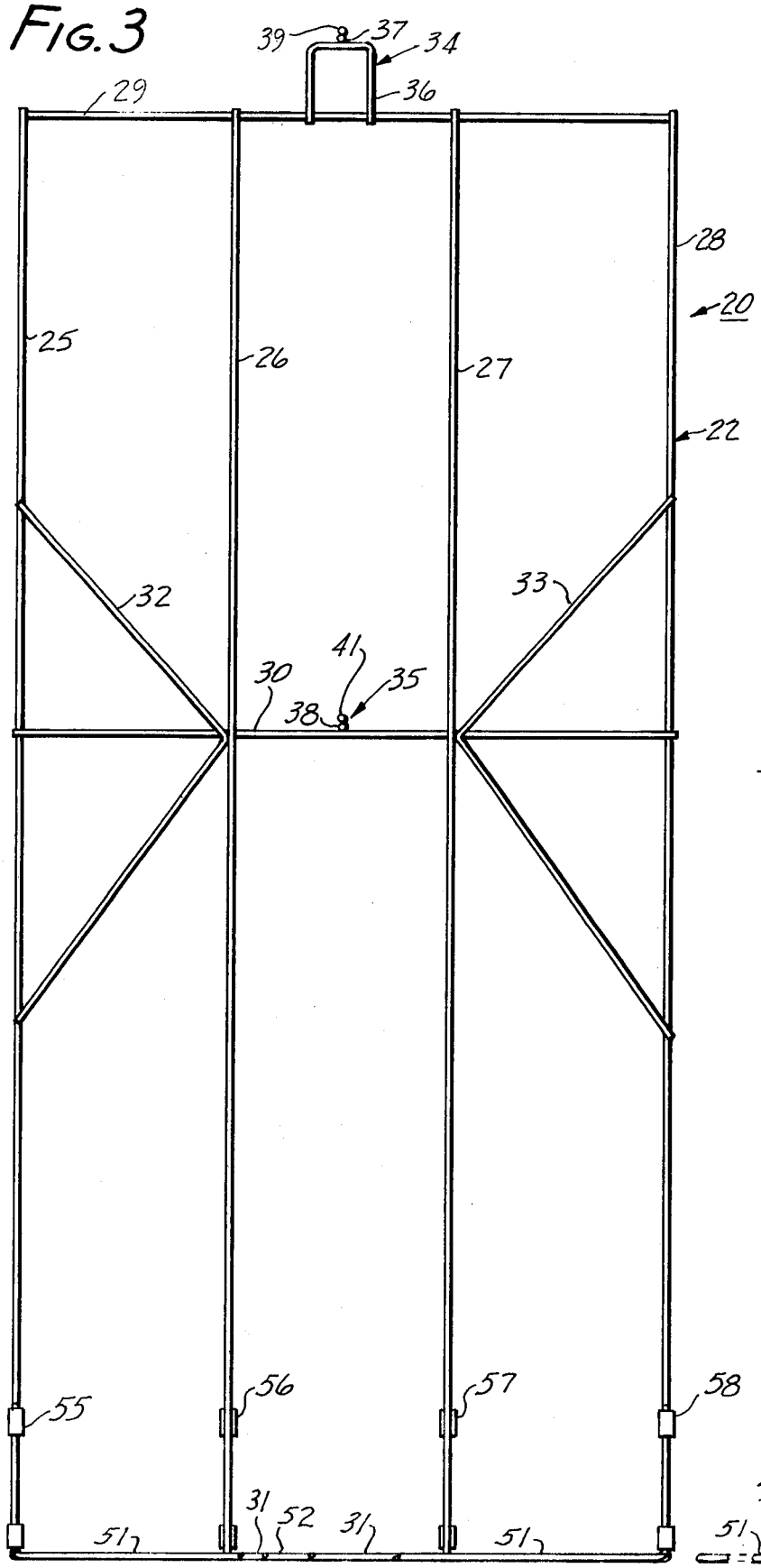
FIG. 3 is a front elevation of FIG. 1 with the support boards removed.
Figure 4:
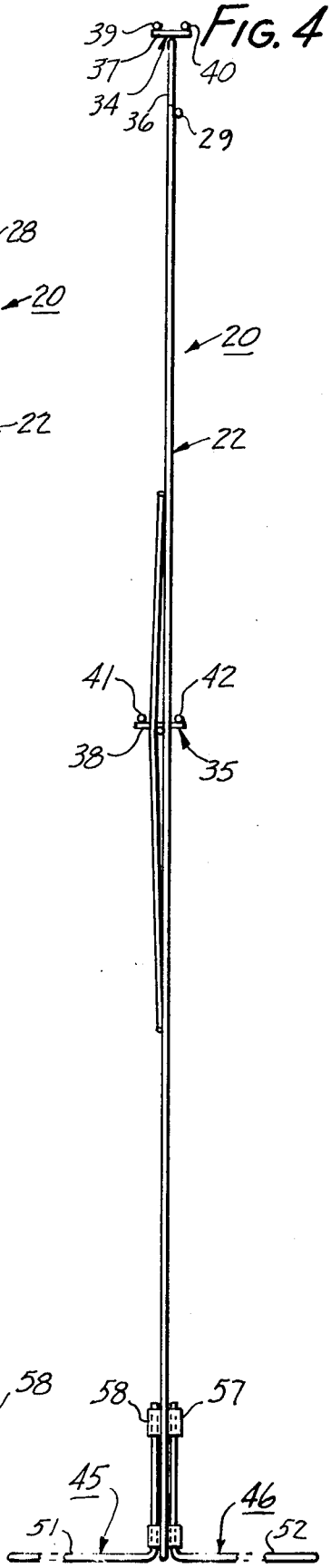
FIG. 4 is a right-hand side elevation of FIG. 3.
Figure 6:
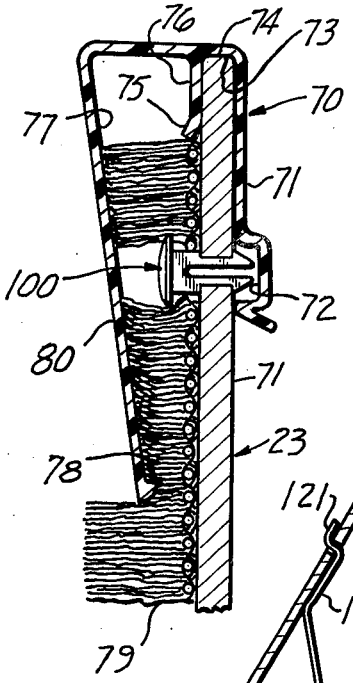
FIG. 6 is a fragmentary section taken at line 6—6 in FIG. 1.

As best shown in FIGS. 3 and 4, the floor stand member 22 may conveniently be made of low carbon steel tubing, for example, square tubing with ½-inch by ½-inch outside dimensions. Such tubings can readily be cut to length, bent, and spot-welded.

It is also possible to make the device from low carbon steel rod, which will require more bracing than the square tubing, but which can be as small as ⅜-inch outside diameter. For such a construction (as shown), a plurality of vertical risers 25, 26, 27, 28 are formed together with three transverse members 29, 30, 31. Sway brace members 32, 33 extend transversely as shown to give transverse rigidity to the structure. Spot welds may be used at all illustrated intersections to join the rods. Vertical risers 25 and 28 may be made integral with transverse member 31 by making the bends as shown at the lower left- and right-hand corners, thereby eliminating two spot welds. A pair of suspension members 34, 35 are attached respectively to transverse members 29 and 30. The upper suspension member may conveniently comprise a U-shaped member 36 for purposes yet to be disclosed.

Figure 18:
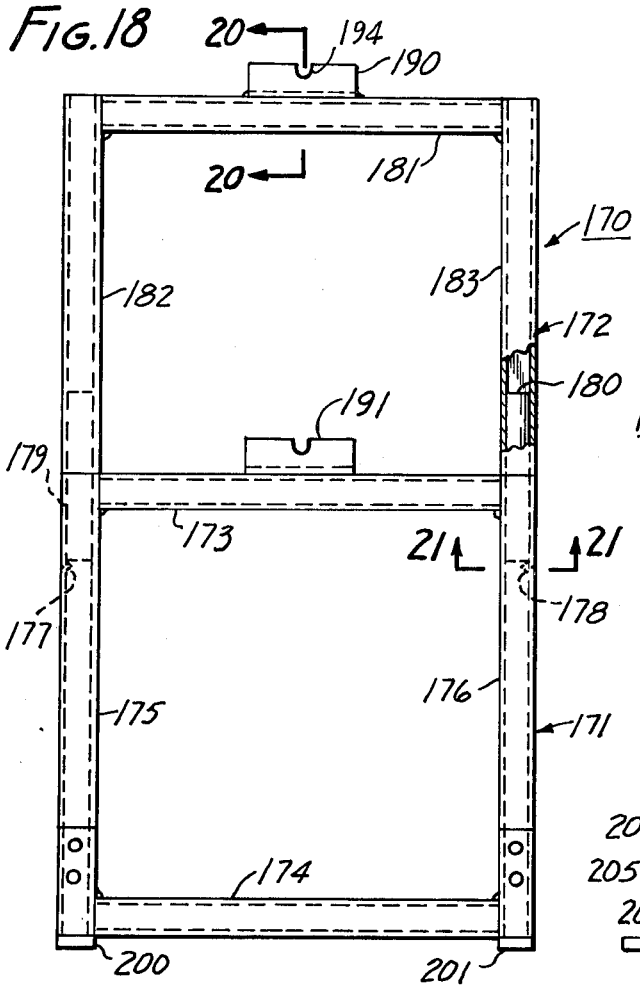
FIG. 18 is a front elevation of the presently-preferred embodiment of the invention.

For actually suspending the support boards, the suspension members may include rods 37, 38 on which balls 39, 40, 41, 42 are spot-welded to provide retention means. The suspension members thereby provide a hook for luggage-type handles or for coathanger-type hooks, such as hooks 43 and 44 in FIG. 1. When the more rigid square tubing is used, less, if any, reinforcement will be needed, and the various cross-members will be omitted. FIG. 18 shows a simple construction of this type.

Figure 5:
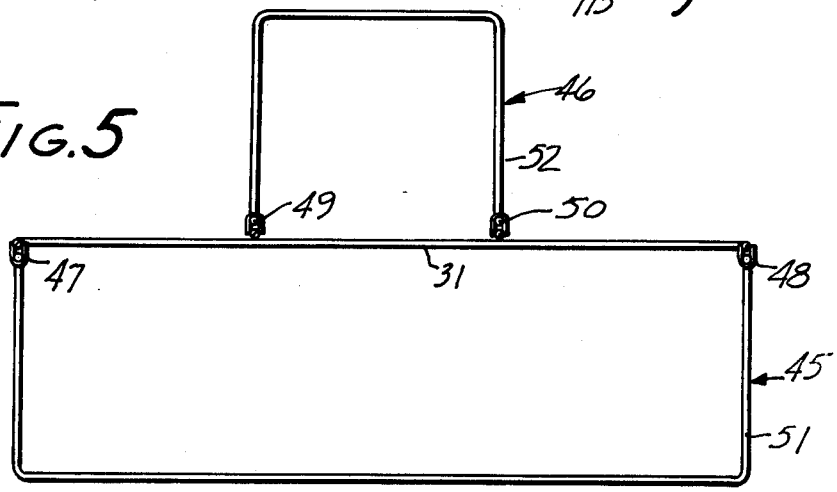
FIG. 5 is a cross-section taken at line 5—5 in FIG. 2.

Foot members 45, 46 (see FIG. 5) comprise U-shaped members with upwardly-extending legs 47, 48, 49, 50. Their U-shaped portions 51, 52 are adapted to rest on the floor, and the legs are intended to be retained in channel members 55, 56, 57, 58. This is a convenient and inexpensively manufactured floor stand member including foot means. The structure will be free-standing when the legs are inserted into the channel members. The foot members can be separated therefrom so that the device can be shipped in less bulk. It will be evident that foot members different from those shown can be utilized, some of which may be foldable if the greater expense of a foldable structure is tolerable. It will also be evident that the foot members of one embodiment can, in general, be used with floor stand members of any desired configuration.

Returning to FIG. 1, the support board is generally rectangular. Because it is not visible when covered with samples, the support board may be made of inexpensive material, such as fiberboard. The material should be rigid enough to withstand the abuse of handling and strong enough to support the samples. It should also be suffciently rigid that holes may be drilled, or preferably punched, therein to receive fasteners for the retention of samples.

Figure 10:
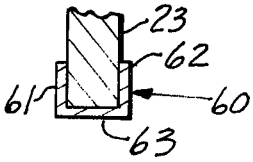
FIG. 10 is a fragmentary cross-section taken at line 10—10 of FIG. 1.

To improve the appearance of the support board, a trim strip 60 (see FIG. 10) with a U-shaped section, having a pair of sidewalls 61, 62 and a connecting wall 63, covers its lower and two side edges. The strip may be mitered at bends 64, 65 so that when wall 63 is bent, the edges of the mitered cutouts come into adjacency as shown in FIG. 1, and thereby provide from a single length of notched trip strip a substantially continuous and attractive trim around the exposed lower three edges. The trim strip is frictionally engaged to the support board, although it may be glued thereto, if preferred.

The upper edge of the support board may conveniently be trimmed with a finishing strip 70 which comprises a U-shaped structure having a rear wall 71 with a channel 72 to fit over and shield the exposed rear portion of a fastener which is yet to be described. Strip 70 also has an edge-receiving channel 73 to receive the upper edge 74 of the support board, a deflector 75 on flange 76, and a finishing flange 77 with a hook 78 on the end thereof. The finishing flange 77 is sufficiently flexible that when it is attached to the upper edge 74, it can be sprung to pass over the upper edge of the sample 79 and will return to embed itself partly into the pile of the carpet so as to be firmly engaged to the sample. This flange provides a surface 80 visible to the purchaser which can carry advertising or decoration.

One useful hanger means for hanging the support boards on the suspension member is a hook 43, 44 attached to the support board near its upper edge. An alternate hanger means is shown in FIG. 17. A retention member 81 comprises a screw with a head 82. The screw is threaded into the support board so that its head is aligned with and fits into channel 72 of a length of finishing strip 70. The screw head may instead form part of a rivet or other object. It is larger than the separable fasteners which are used to mount the samples to the support board, and is more permanently attached. When retention members are used, the finishing strip will be slid onto the board from its side edge so the head will reliably hold the finishing strip to the support board. A hangar means in the shape of a luggage handle 83 is attached to finishing strip 70, and the luggage handle can be used to hang the support board on the stand member. Hooks 43, 44 can then be eliminated. The retention member 81 makes a strong enough connection to the support board that the board can be supported through it by handle 83.

Figure 2:
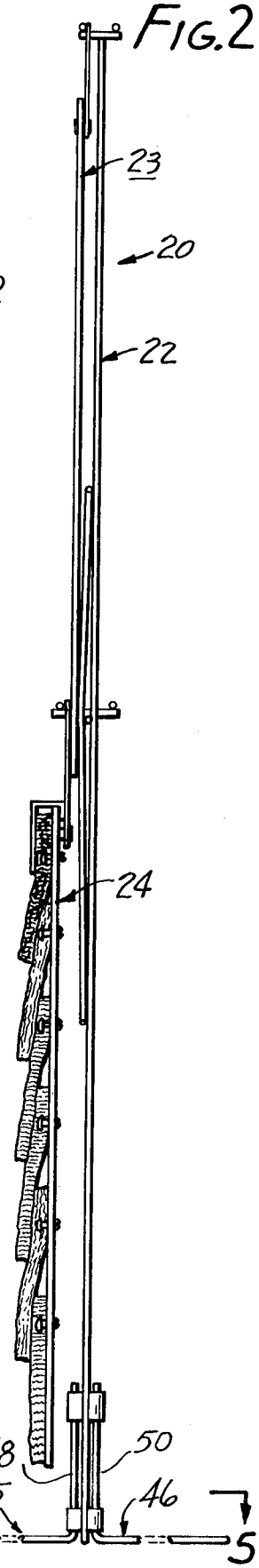
FIG. 2 is a right-hand side elevation of FIG. 1.

The hole pattern in the support board is devised to enable different patterns of samples readily to be assembled and attached. The most popular display pattern expected to be utilized is that shown in FIG. 1, wherein there is a major (i.e., larger) central sample 85 of a color of most general appeal. A plurality of minor (i.e., smaller) samples are placed in rows 86, 87 at each side of the central sample. The minor samples usually will be shingled relative to one another, as best shown in FIG. 2, with a surface of each visible to a shopper. The major sample may either underlay or overlay these minor samples, if preferred, but the most effective display appears to be that which is illustrated.

Aperture columns 90, 91, 92 and 93 (FIG. 1) are provided for attaching the minor samples. Aperture columns 94 and 95 are provided for the major central samples. Central aperture columns 96, 97 are provided for display of intermediate size samples to be used with apertures in columns 90, 91, 92 or 93.

Attachment apertures 99 (the holes near the upper and lower edges) are provided for suspending the board on hooks or nails, should such mode of display prove more desirable for a given installation.

Figure 7:
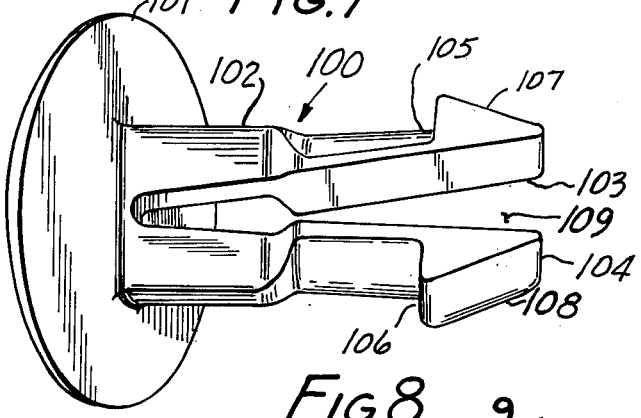
FIG. 7 is a perspective view of a separable fastener useful with this invention.

A suitable separable fastener 100 (FIG. 7), which resembles a staple, comprises a head 101, a shank 102, and a pair of spring-like fingers 103, 104, each having a recess 105, 106 and a deflector surface 107, 108. The deflector surfaces push the spring-like fingers toward one another when the fastener is pressed into a hole. Channel 109 between the fingers enables sufficient deflection of this type to occur so that the shank can be passed through a respective hole (the terms "aperture" and "hole" are used interchangeably) in the support board which is at least as large as the transverse dimension of the compressed-together finger combination, but smaller than the transverse dimension when they are sprung apart. After the "points" pass through the hole, the fingers spring out so that surfaces 110, 111 catch against the back face of the board. The recesses receive the support board and are axially at least as long as the board is thick. A hole will usually be punched through the carpet sample so that the shank can more readily be passed through the carpet. Loosely woven structures can directly be pierced by the fastener. The diameter of the head will be larger than the hole in the carpet so as to hold the sample against the board. This is a readily-removable and attachable fastener system which can quickly and expeditiously attach the carpet sample to the support board. Attachment is accomplished as already described. Removal is accomplished by pinching the free ends of the fingers together and pulling the sample away from the support board while they are held together.

Persons skilled in the fastener art will readily recognize that there are many other separable fasteners which could be used instead. The term "separable" is used in the sense that the fastener itself is separable from the board, rather than that the fastener itself is made of a plurality of parts. Fasteners having pluralities of parts, such as nuts and bolts, are also useful, but are less desirable for this usage because their parts can be mislaid. A one-piece fastener is to be preferred. The term "separable" distinguishes this fastener from a permanent fastener, such as an upset rivet or a pressed grommet.

Fastener 100 has the advantage that all assembly work can be done from the front side. When the desired pattern of holes has been selected, a template may be provided that blocks off all holes except those which are to receive a fastener, and the sample board can quickly be assembled using customary and convenient assembly techniques, working from the front side only.

Channel 72 receives and protects the back end of the uppermost fastener means. This reduces the tendency for the assembly to come loose as a consequence of contact with neighboring structures.

Figure 8:
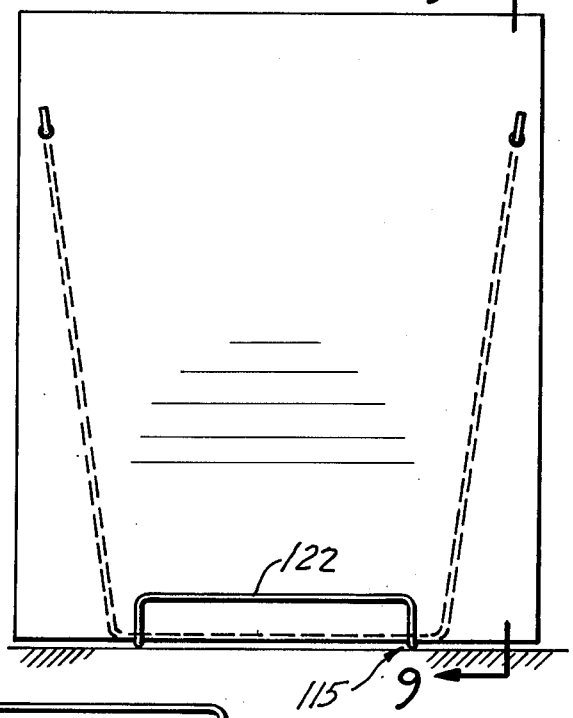
FIG. 8 is a front elevation of another embodiment of the invention.
Figure 9:
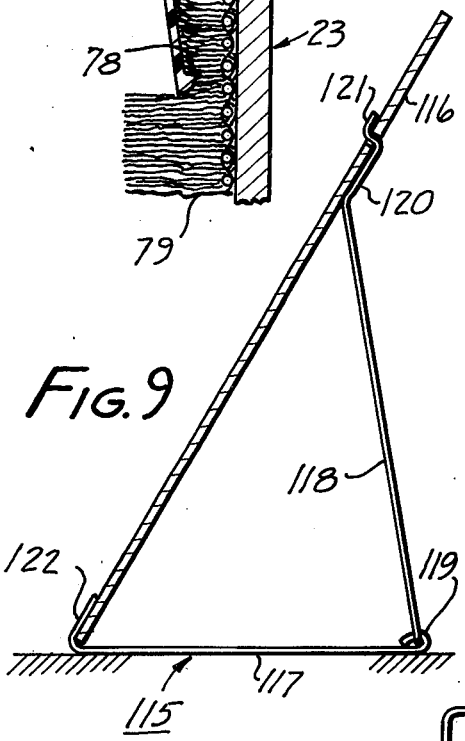
FIG. 9 is a cross-section taken at line 9—9 of FIG. 8.

The display system of FIGS. 1–5 utilizes the foot members shown. However, the support board is useful with other classes of floor stand members, for example, the easel 115 of FIGS. 8 and 9. As will later be seen, the support board can instead be hung from a wall. In the embodiment of FIGS. 8 and 9, a support board 116, having the same construction as support boards 23 and 24, is shown supported by an easel which has a foot member 117 and an upright member 118. Members 117 and 118 are hinged together at hinge joint 119. The upright member includes a backing section 120, against which the support board rests, and a hook section 121, which is passed through one of the attachment holes so as to engage the support board. A trough section 122 is formed by an upward bend in the foot member to restrain the bottom edge of the support board. The holes in the support board are not shown in FIGS. 8 and 9 in order to simplify the drawings. They are present in the actual support board.

FIG. 11 shows another embodiment of the invention. Stand 125 includes a pair of side frame members 126, 127 jointed by at least one lateral member 128. STuds 129 rising from the side frame members can fit in attachment holes 99 to hold a support board 130 in place. The hole patterns in support board 130 may be identical to those in support boards 23 and 24. They are not shown in this FIG. in order to simplify the disclosure. They are present in the actual support board. Structure 125 does not fold. It can, however, be disassembled. Easel 115 folds and is not usually disassembled. In FIG. 11 portions of the side frame members which contact the ground are sometimes referred to as "support means," and the remainder, including lateral member 128, is sometimes referred to as a "frame member," the support means supporting the frame member.

FIG. 12 shows a series of floor stand members arranged in a horizontal array without foot members. In this embodiment, floor stand members 131, 132, 133 (identical to member 22) are provided with hinge halves 134, 135, 136, 137, 138, 139, 140, and 141. Hinge pins 142 join the hinge halves. In this way, a construction such as shown in FIG. 13, which is free-standing, can be arranged without foot members by placing them at an angle to each other (FIG. 13). These members are used to hold support boards as previously disclosed for the other embodiments.

FIGS. 14–16 show another embodiment of foot member 145 for use with the construction of FIGS. 1–4. In this embodiment, a base plate 146 is attached across the bottom of floor stand member 22 (or any other type of floor stand), and sets of pairs of holes 147, 148 are drilled through the base plate. Two foot members 149, 150 are attached to the plate. The foot elements are U-shaped and have threads 151, 152 on their ends. As best shown in FIG. 15, the foot elements 149 and 150 are attached to respective ones of the holes in each pair of holes 147 and 148. A first nut 153 is run down on each thread so as to bottom on the end of the threads. The remaining portion of the threaded end is passed through a respective hole. Then a second nut 154 is threaded onto the end of each thread to attach the foot member to the base plate. With this arrangement, a foot member is expediently provided which can be shipped in a smaller package than the foot element shown in FIG. 1.

In addition to the sample array display of FIG. 1, the hole pattern enables the display of a plurality of intermediate-sized samples, which may be some fraction such as ½, ⅓ or ¼ of the width of the support board. For one arrangement, holes in rows 93 and 97, and in 90 and 96, will ordinarily be used. These samples may be put in shingled or one-above-the-other edge-abutting relationship. It is possible that larger central sections may be desired, perhaps to be shingled or not, and in this case, more than one each of holes from rows 94 and 95 will be used. The illustrated holes are uniquely adapted to display various patterns of samples with different variations of large samples in the center and small shingled patterns on the side, or of large patches of sections in two columns, or in any mixture of these.

The relatively small number of holes in columns 94 and 95, and the substantial equality of holes in columns 90, 91, 92 and 93, enable a wide range of pattern display arrays to be utilized with the same board, and the board may be re-used again and again with the same or a different array. It is evident that different hole patterns may be formed to accommodate different display arrays.

Once an array has been decided on, a template can be designed and placed over a light box so that light shines only through the holes to be used. Fasteners are then placed in the lighted holes. The light box is not needed, because the template excludes fasteners where they do not belong, but it does aid in the assembly process. With the samples pre-punched, the separable fasteners are inserted in the carpet and pressed directly into the respective indicated or open holes. This system enables the shingled or other patterns shown to be assembled quickly by unskilled personnel, and provides means for displaying every color simultaneously. The separable fastener enables samples readily to be removed without destroying the general attractiveness of the display. They can also be removed and replaced when colors are discontinued and new colors are added to the line. It is only necessary to ship the new small sample to the store. A major revision of a permanent assembly is not required.

Figure 19:
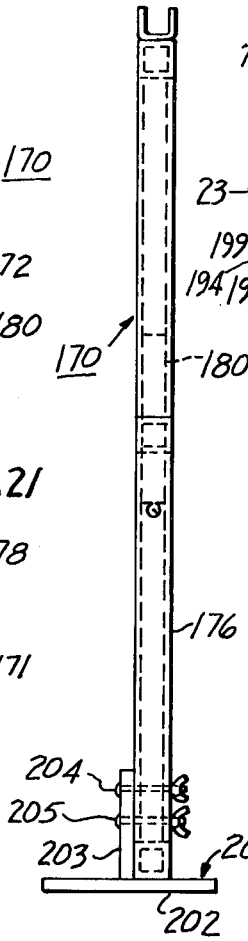
FIG. 19 is a right-hand elevation of FIG. 18.
Figure 20:
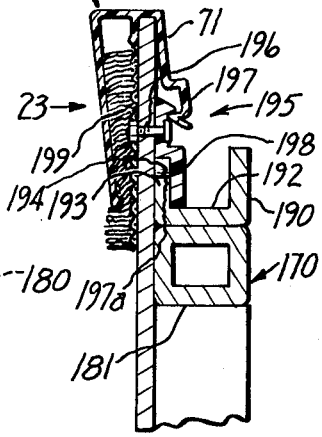
FIG. 20 is a cross-section taken at line 20—20 of FIG. 18 with a support means added for further illustration.
Figure 21:
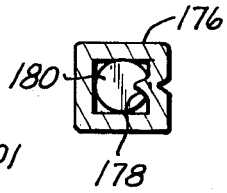
FIG. 21 is a cross-section taken at line 21—21 of FIG. 18.

Another embodinment of floor stand member 170 is shown in FIGS. 18–20. Optimum rigidity and ease of fabrication and assembly is obtained by constructing it of low-carbon tubular steel with a square cross-section. The stand member is made with a lower portion 171 and an upper portion 172. The lower portion is a square frame. Two transverse members 173, 174 are butt-welded to two upright members 175, 176. The upper ends of members 175 and 176 are open. Staked-in posts 177, 178 are positioned in the passages of members 175, 176 to stop dowels 179, 180 which fit into the passages and rest atop the posts. They project above the top ends of members 175 and 176.

Upper portion 172 is U-shaped. A transverse member 181 is butt-welded to upright members 182, 183. The lower ends of members 182, 183 are open and fit down over the dowels to assemble the portions together.

Suspension members 190, 191 are respectively attached to transverse members 181 and 173. They are identical, so only member 190 will be described in detail. It is a U-shaped channel having a base flange 192 and a suspension flange 193. Flange 192 is welded to transverse member 181. A notch 194 is formed in the suspension flange to center the support board.

A hangar means 195 is fastened to support board 23 by fasteners 196. It can be a plastic cast body with a joggle 197 to hook over suspension flange 193. A centering post **197*a* fits into notch 194 to center the hanger. Rear wall 71 of finishing strip 70** deflects to fit over part of the hanger. The hanger and suspension member need not be more than about two to three inches long, because this will provide sufficient support, even if the support board is located somewhat to one side of center.

Foot members 200, 201 are formed of a base plate 202 and an upright piece of plate or square tubing 203 ("uprights") welded to the base plate. Appropriate holes are drilled through the upright members 175 and 176 and through uprights 203. Fasteners 204, 205 join the members and uprights together. This group of parts can be shipped in an optimally small container and can readily be assembled without special tools.

Figure 25:
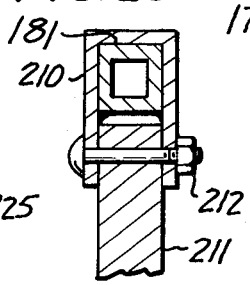
FIG. 25 is a cross-section taken at line 25—25 of FIG. 26.
Figure 26:
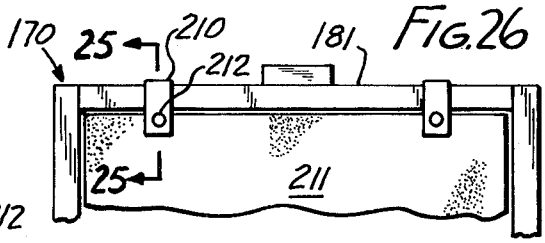
FIG. 26 is a fragmentary elevation of the stand member of FIG. 18 with an additional feature added thereto.

FIGS. 25 and 26 show clips 210 placed over transverse member 181, and a center board 211 fastened inside the portion by fastener 212, where it can provide advertising display space. It obviates the open skeletal appearance which results when the support board is removed and nothing else is in this space.

Figure 22:
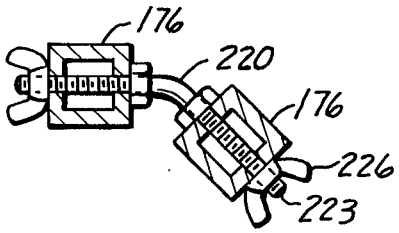
FIGS. 22, 23 and 24 are cross-sections showing means to attach stand members together for mutual support.
Figure 23:
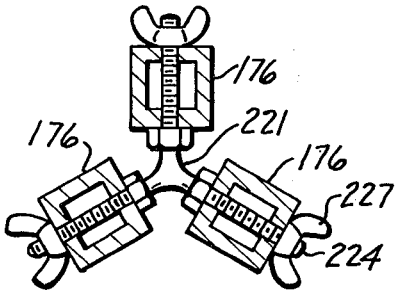
Figure 24:
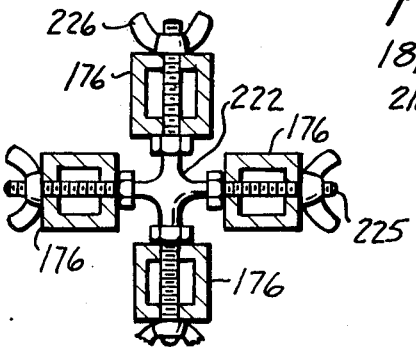

FIGS. 22–24 show means to hold the floor stand members vertical without using foot members. In FIGS. 22, 23 and 24, tie members 220, 221 and 22 have threaded shanks 223, 224, 225 and wing nuts 226, 227 and 228. The threaded shanks are passed through holes in upright members of the floor stand members to tie them together in groups of two (FIGS. 22), three (FIG. 23) or four (FIG. 24), and combinations of these. Tie members 220 is bent so the two floor stand members will not be coplanar. In the various numbers, the floor stand members are mutually supportive without foot members. If foot members are provided, a plurality of these may be disposed in line.

Figure 27:
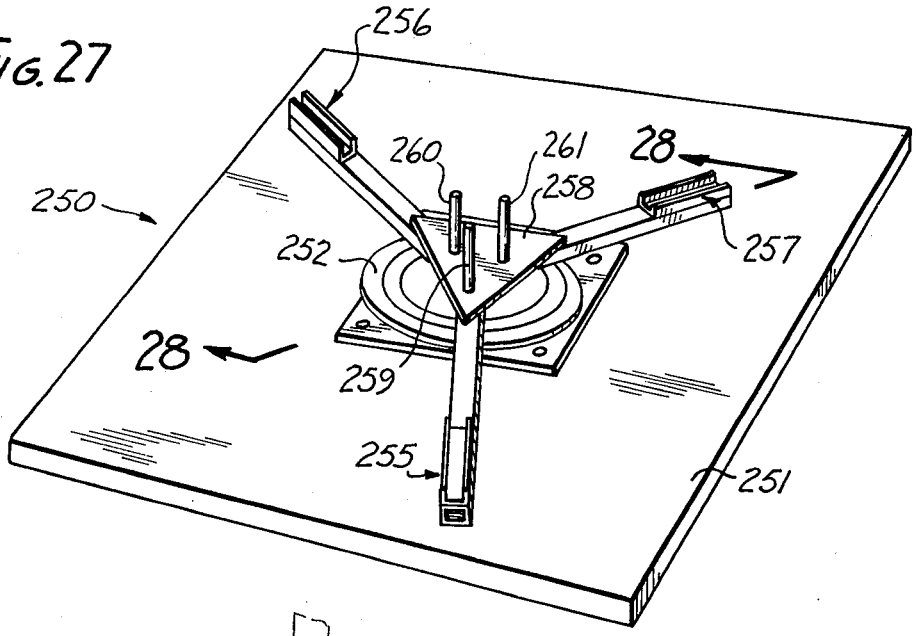
FIG. 27 is an oblique view of another embodiment of the invention.
Figure 28:
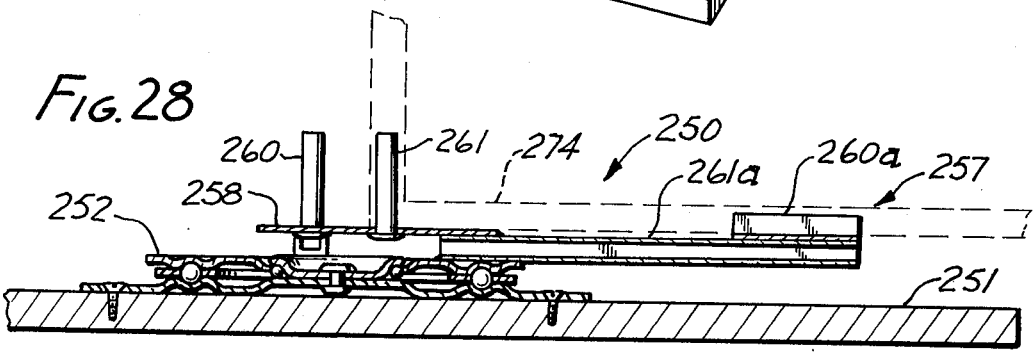
FIG. 28 is a cross-section taken at line 28—28 of FIG. 27.

FIG. 27 shows a rotatable display 250. It includes a turntable base 251 with a conventional turntable 252 mounted to it. The axis of rotation is vertical. Coupling means 255, 256 and 257 are alike, and more or fewer can be provided. Only means 257 is described in detail. They are attached to plate 258 and extend laterally outward. Posts 259, 260 and 261 project upwardly from plate 259, and can fit into a hole in the bottom of frame 171 of FIG. 18. A channel member **260*a* is attached to arm 261*a* of the coupling member. It opens upward to receive and cradle the bottom member 174**. The frame can readily be removed and replaced, and is reliably supported by the coupling means. The frames rotate on the turntable.

Figure 29:
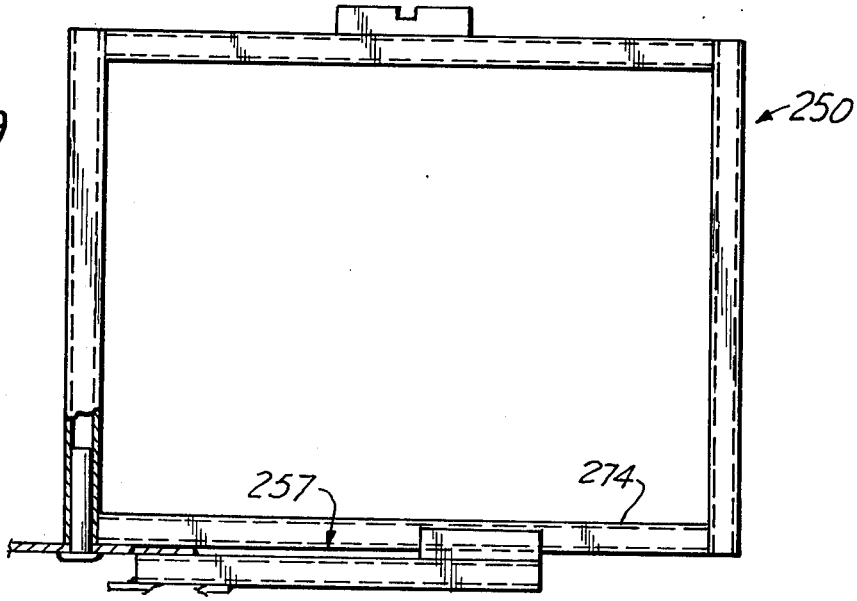
FIG. 29 is a side view of a portion of FIG. 27.

FIG. 29 shows that the frame 265 can be one unit high instead of two or more, as desired.

Figure 30:
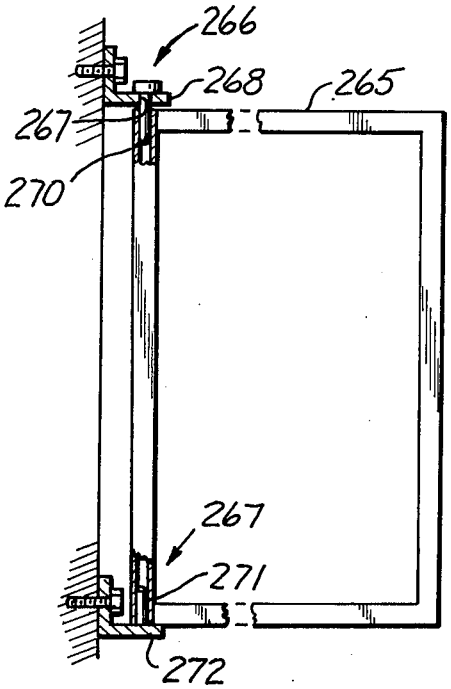
FIG. 30 is a side elevation of still another embodiment of the invention.

FIG. 30 shows a frame 265 according to FIG. 18 mounted to the wall. Coupling means 266, 267 comprises L-shaped angle iron mounted to the wall. Upper flange 268 has a plurality of holes 269 to receive headed bolts 270 to project downward into the frame. Studs 271 project upward from lower flange 272. The frames are thereby hinge-mounted to the wall, and are adapted to mount support boards as in FIG. 18.

Figure 31:
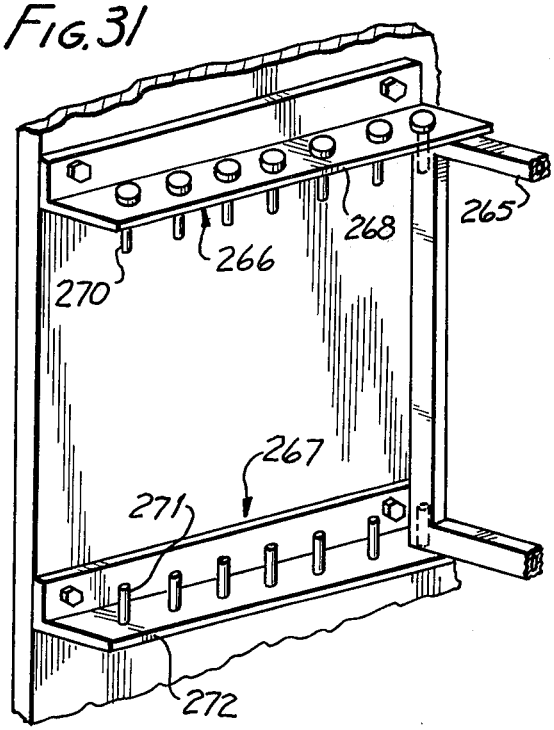
FIG. 31 is an oblique view of FIG. 30.
Figure 32:
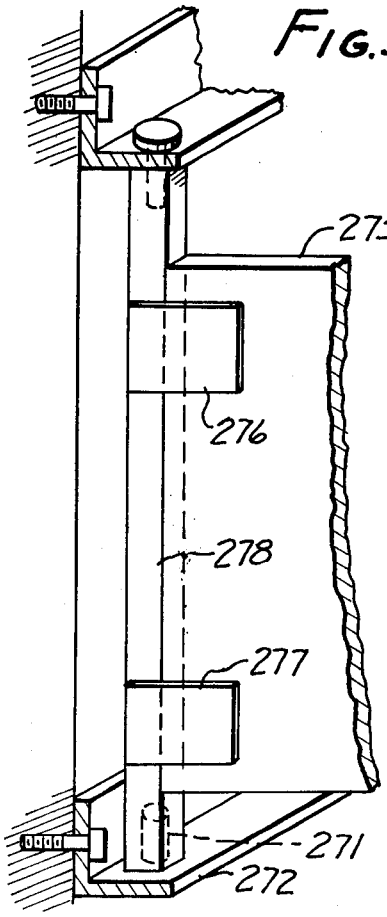
FIG. 32 shows a modification of the device of FIG. 30.

FIG. 32 shows the system of FIG. 31 with the difference that frame 275 (schematically shown) is attached by clamp means 276, 277 to a pivoted post 278 that is held by the coupling means.

Figure 33:
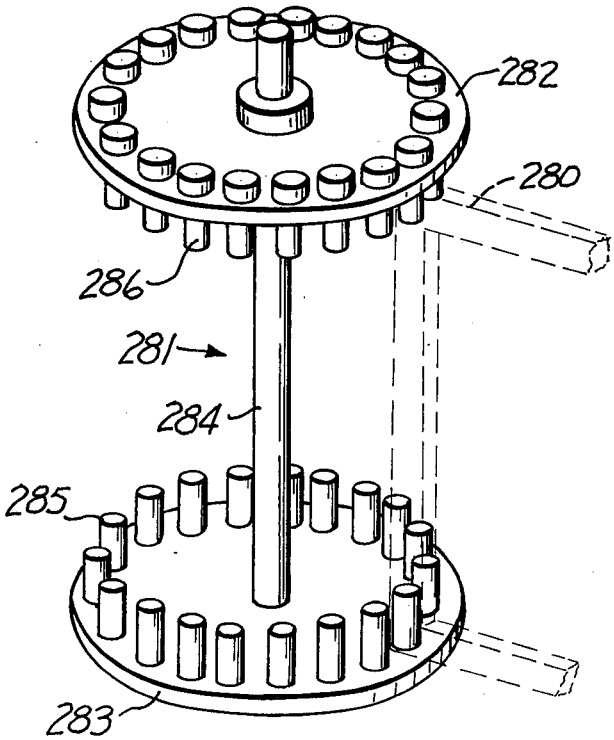
FIG. 33 is an oblique view of yet another embodiment of the invention.

FIG. 33 shows a frame 280 supported on a carousel mount 281. This mount comprises top and bottom plates 282, 283 mounted to post 284. Bottom plate 283 may be the top plate of a turntable (not shown), so that everything rotates with it, or the post may be rotatable, and the plates rigidly connected to it so as to turn with the post. Studs 285 and bolts 286 are provided to complete the coupling means as in FIG. 30. A frame 280 of the FIG. 18 type is thereby both hingedly and rotatably mounted.

Accordingly, this invention provides a support board and display system which enables samples inexpensively to be assembled and shipped and kept up to date. It is adaptable to free-standing displays, to attachment to wall fixtures, and the like. Also, support floor stand means are shown for supporting this member in an attractive display, economical of floor space.

This invention is not to be limited by the embodiments shown in the drawings and described in the description, which are given by way of example and not of limitation, but only in accordance with the scope of the appended claims.

We claim:

1. A support board for removably supporting floor covering samples, comprising: a rigid board with a plurality of parallel columns of apertures through the board, at least some apertures in adjacent columns being disposed at equal elevations, there being a plurality of said elevations, whereby a plurality of samples can be attached to the support board, one above the other, said board having a top edge; a plurality of separable fasteners adapted to be passed in pairs through a floor covering sample and inserted in respective ones of the apertures, whereby to be engaged to the support board and hold a respective sample thereto; and a finishing strip engaged to the top edge of the support board, said finishing strip comprising a rear wall, a first flange spaced from said rear wall to form a channel to receive and embrace the board at said top edge, a finishing flange spaced from the first flange and extending beyond it, whereby to overlay part of a sample on the board, said finishing flange being flexible to spring over and clamp upon said sample.

2. A support board according to claim 1 in which there are two pairs of said columns of apertures, one at each of two parallel sides of the support board, and a third pair of columns of apertures between the said first two pairs, whereby a central sample or samples can be attached between a column of samples on each side thereof.

3. A support board according to claim 1 in which hanger means is attached to the support board for hanging up from a support means, said hanger means comprising a downwardly projecting member adapted to overhang an upwardly projecting suspension member.

4. A display system comprising in combination: a support board according to claim 3; and a stand member for supporting the support board.

5. A display system according to claim 4 in which a suspension member including an upstanding flange is attached to and rises above the frame, said hanger means overhanging said suspension member.

6. A display system according to claim 5 in which the flange has a notch, and the hanger means has a rod engageable in the notch to discourage sideward sliding movement of the hanger means on the flange.

7. A support board according to claim 1 in which a headed body is attached to the support board, and in which a second channel is formed in the finishing strip to receive a projecting portion of the headed body, whereby to hold the finishing strip to the support board.

8. A support board according to claim 7 in which a handle is attached to said finishing strip.

9. A support board according to claim 1 in which a hook is formed on the free end of said finishing flange to engage a sample.

10. A display system comprising in combination: a support board according to claim 1; and a stand member for supporting the support board.

11. A display system according to claim 10 in which the stand member comprises an easel.

12. A display system according to claim 11 in which the easel is a folding structure.

13. A display system according to claim 10 in which the stand member comprises a plurality of rigid vertical risers and a plurality of rigid transverse members integrally fastened together, and in which a foot member is removably attachable to the stand member.

14. A display system according to claim 13 in which the foot member comprises a U-shaped structure, and attachment means is provided to attach the foot member to the stand member.

15. A display system according to claim 14 in which the attachment means comprises channels on the stand member and legs on the foot member receivable in the channel.

16. A display system according to claim 14 in which the attachment means comprises threads on the U-shaped structure, and nuts engageable thereto to hold the U-shaped structure to the stand member.

17. A display system according to claim 10 in which the stand member comprises a rectilinear frame made of square cross-section tubing, and a plurality of foot members releasably attached to said frame.

18. A display system according to claim 17 in which the foot member is at least in part comprised of square cross-section tubing.

19. A display system according to claim 17 in which a suspension member including an upstanding flange is attached to and rises above the frame, and in which a hanger member is attached to the support board having a downwardly-depending joggle adapted to overhang and engage the flange to support the support board.

20. A display system according to claim 19 in which the flange has a notch and the hanger has a rod engageable in the notch to discourage sideward sliding movement of the hanger on the flange.

21. A display system according to claim 10 in which the fastener comprises a shanked body having a pair of spring fingers adapted to deflect to pass into a respective aperture, and having hooks to spring out and bear against a side of the support board to hold the fastener in an aperture.

22. A display system according to claim 10 in which hinge means is provided to join a plurality of stand members foldably together.

23. A display system according to claim 10 in which connector means is provided to connect a plurality of said stand members together.

24. A display system according to claim 23 in which said connector means connect the stand members out-of-line so they are self-standing without foot members.

25. A display system according to claim 10 in which wall support means comprising a pair of flanges directed outwardly from the wall are located one above and the other below the stand means, the flanges supporting elongated members to enter apertures in the stand member pivotally to support the stand member near an edge thereof.

26. A display system according to claim 10 in which a rotatable post is supported between two flanges adapted to be mounted to a wall, and in which support means is provided to attach the stand member to said post.

27. A display system according to claim 10 in which a turntable supports a plurality of said stand members.

28. A display system according to claim 27 in which the turntable includes a plurality of arms, each arm including a channel to receive the bottom of a stand member, and in which an upwardly-extending post is provided adjacent each clip to enter the stand member.

29. A display system according to claim 27 in which a top and bottom rotatable plate includes an elongated member adapted to enter the top and bottom of the stand member, whereby both hingedly and rotatably support the stand means.

30. A display system according to claim 10 in which the stand member comprises a lower portion and an upper portion, the lower portion comprising two transverse and two upright members rectangularly joined together, the upper portion comprising a U-shaped structure having one transverse and two upright members, the upper ends of the upright members of the lower portion and the lower ends of the upright members of the upper portion having alignable openings, and a dowel inserted in said openings to join said portions.

31. A display system according to claim 30 in which all of said transverse and upright members are elongated and tubular, with rectangular internal and external perimeters.

32. A display system according to claim 30 in which a foot member is attachable to each of the upright members of the lower portion.

33. A display system according to claim 32 in which the foot member comprises a pair of elongated members joined together at a right angle to one another.

34. A display system according to claim 30 in which rigid tie means are attachable to an upright member of a plurality of said stand members to hold them together.

35. A display system according to claim 34 in which the tie means hold the stand members out-of-line so they are mutually self-supporting.

36. A display system according to claim 34 in which all of said transverse and upright members are elongated and tubular, with rectangular internal and external perimeters.

37. A display system according to claim 30 in which a suspension member is attached to a transverse member of each portion, said suspension member including an upstanding flange, and in which a downwardly-depending hanger means is attached to the support board to engage said suspension member.

38. A display system according to claim 30 in which a clip overhangs one of the transverse members, and in which a fastener fastens a central member to the clip, the central member being coplanar with the respective portion.

39. A support board according to claim 1 in which the fastener comprises a shanked body having a pair of spring fingers adapted to deflect to pass into a respective aperture, and having hooks to spring out and bear against a side of the support board to hold the fastener in an aperture.

40. A support board according to claim 1, in which a trim strip engages at least three edges of a rectangular support board, the trim strip being U-shaped, and mitered at two bends where the said edges intersect.

41. In combination: a support board according to claim 1, and a plurality of floor covering samples attached thereto by said separable fasteners, utilizing at least two pairs of said apertures.

42. A display system comprising in combination: a support board according to claim 1; a frame member; support means supporting the frame member; hanger means attached to the support board; and suspension means attached to the frame member, said hanger means being engageable to the suspension means to hold the support member on the frame member.

* * * * *